US007403723B2

(12) United States Patent
Moriya et al.

(10) Patent No.: US 7,403,723 B2
(45) Date of Patent: Jul. 22, 2008

(54) IMAGE FORMING APPARATUS WITH MEASURING TECHNIQUE

(75) Inventors: Hideki Moriya, Kanagawa (JP); Chikaho Ikeda, Kanagawa (JP); Hidehiko Yamaguchi, Kanagawa (JP); Masao Ohmori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 98 days.

(21) Appl. No.: 11/389,094

(22) Filed: Mar. 27, 2006

(65) Prior Publication Data

US 2006/0222381 A1 Oct. 5, 2006

(30) Foreign Application Priority Data

Mar. 29, 2005 (JP) ..... 2005-095836
Jan. 13, 2006 (JP) ..... 2006-006749

(51) Int. Cl.
*G03G 15/00* (2006.01)

(52) U.S. Cl. ..... 399/26

(58) Field of Classification Search ..... 399/26, 399/50–53

See application file for complete search history.

(56) References Cited

U.S. PATENT DOCUMENTS 5,159,388 A * 10/1992 Yoshiyama et al. ..... 399/26
2004/0184825 A1 9/2004 Shin

FOREIGN PATENT DOCUMENTS

| | | |
|---|---|---|
| CN | 1530765 A | 9/2004 |
| JP | 59-69774 | 4/1984 |
| JP | 5-223513 | 8/1993 |
| JP | 9-101654 | 4/1997 |

OTHER PUBLICATIONS

Notification of Reason for Refusal, Feb. 8, 2008 by First Patent Examination Department, Amusement (Electric Game) Division. Chuetsu ONO Tel. 03-3581-1101 (Ext. 3264).

* cited by examiner

*Primary Examiner*—Hoang Ngo
(74) *Attorney, Agent, or Firm*—Morgan, Lewis & Bockius LLP

(57) ABSTRACT

An image forming apparatus including a photoreceptor that rotates, a charging member provided in contact with or in close proximity of the photoreceptor to charge the photoreceptor, a charge amount detecting portion that accumulates current flowing across the photoreceptor to obtain a charge amount of the photoreceptor, while the current is being applied from the charging member until a voltage on a surface of the photoreceptor substantially corresponds to the voltage applied by the charging member, and a controller that calculates a film thickness of the photoreceptor based on the charge amount.

12 Claims, 10 Drawing Sheets

DECENTERING AMOUNT = $\cos\omega 1t$

DISTANCE BETWEEN PHOTORECEPTOR AND CHARGING ROLL $\cos\omega 1t + \cos\omega 2t = 2\cos((\omega 1t + \omega 2t)/2) \times \cos((\omega 1 - \omega 2)/2)$

IMAGE FORMING APPARATUS WITH MEASURING TECHNIQUE

This application claims the benefit of Japanese Patent Application No. 2005-095836 filed on Mar. 29, 2005 and Japanese Patent Application No. 2006-006749 filed on Jan. 13, 2006, which are hereby incorporated by reference.

BACKGROUND

1. Technical Field

This invention relates to an image forming apparatus in which an AC bias and a DC bias are applied to charge a photoreceptor uniformly in a contact charging method or a close proximity charging method having the operation principle of discharging, and more particularly, to a measuring technique of film thickness of the photoreceptor.

2. Related Art

Various members such as a charging roller, developing brash, and transferring roller, cleaning brush, cleaning blade, and the like physically come into contact with a surface of a photoreceptor of the image forming apparatus. Such physical contact gradually abrades away a surface of a photoconductive layer along with the repeated image forming process. In particular, the magnitude of sliding frictional forces applied by the cleaning brush or cleaning blade is strong enough to cause the abrasion of the photoconductive layer.

With the afore-described abrasion, if the thickness of the photoconductive layer is reduced by a certain amount, the photosensitivity will significantly degrade or the charging characteristics will be deteriorated. This makes it impossible to charge the surface of the photoreceptor uniformly at a desired potential, and a clear image cannot be formed.

Therefore, the thickness of the photoconductive layer of the photoreceptor is measured as time goes on to estimate the operating life of the photoreceptor.

SUMMARY

According to one aspect of the present invention, there is provided an image forming apparatus including: a photoreceptor that rotates; a charging member provided in contact with or in close proximity of the photoreceptor to charge the photoreceptor; a charge amount detecting portion that accumulates current flowing across the photoreceptor to obtain a charge amount of the photoreceptor, while the current is being applied from the charging member until a voltage on a surface of the photoreceptor substantially corresponds to the voltage applied by the charging member; and a controller that calculates a film thickness of the photoreceptor based on the charge amount.

BRIEF DESCRIPTION OF THE DRAWINGS

Exemplary embodiments of the present invention will be described in detail based on the following figures, wherein.

DETAILED DESCRIPTION

A description will now be given, with reference to the accompanying drawings, of exemplary embodiments of the present invention.

First Exemplary Embodiment

Figure 1:
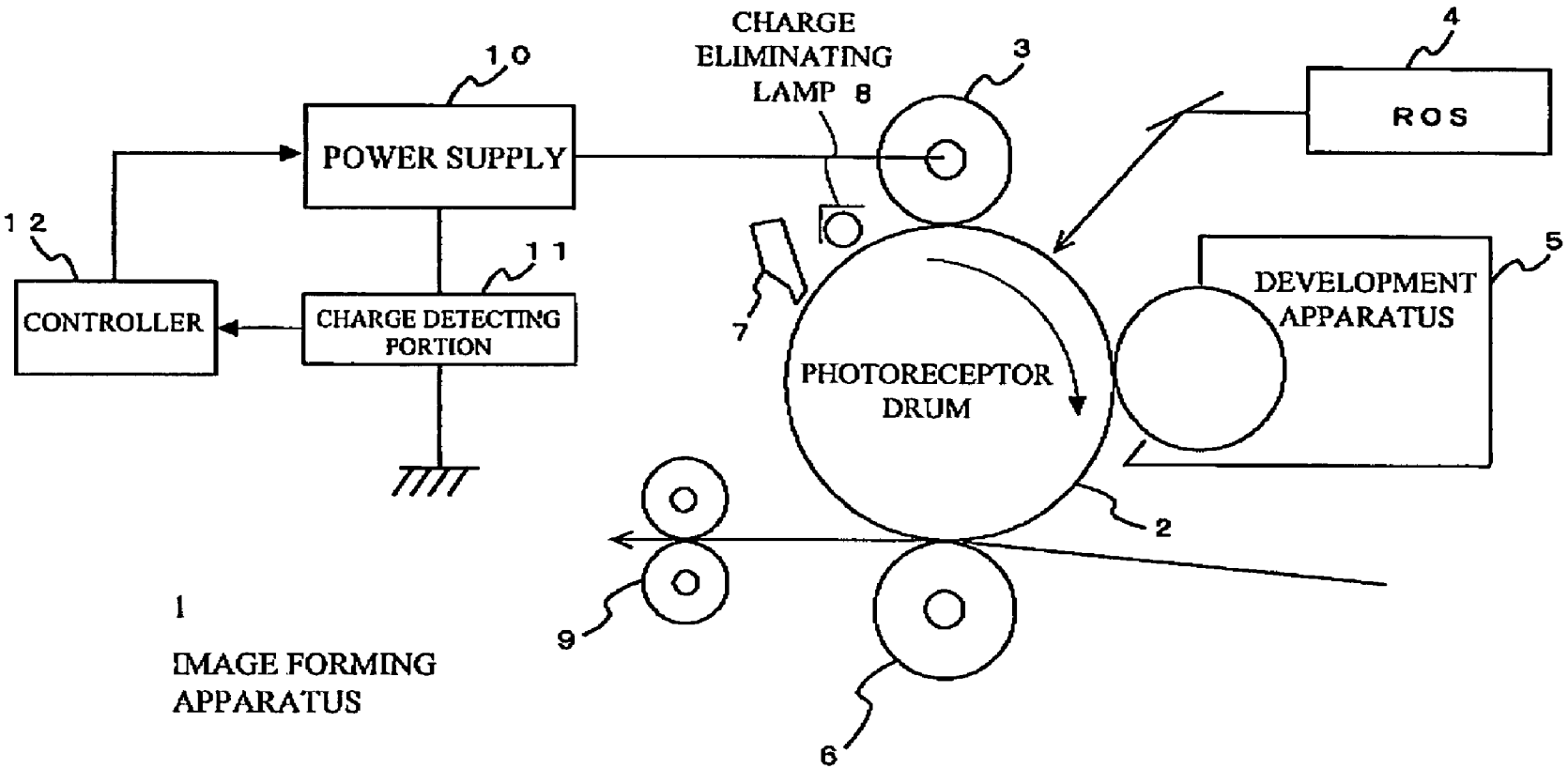
FIG. 1 is a view showing a configuration of an image forming apparatus in accordance with a first exemplary embodiment of the present invention.

Referring to FIG. 1, a description will now be given of a first exemplary embodiment of the present invention. A photoreceptor 2 that serves as an image holder is an OPC photoreceptor having a shape of a drum. The photoreceptor 2 rotates in a clockwise direction, as indicated by an arrow, at a given process speed, namely, circumferential velocity, centering on a central axis thereof perpendicular to the paper surface.

There are provided a charging roll 3 in contact with the photoreceptor 2, a Raster Optical Scanner (ROS) 4 that serves as an exposure apparatus, a development apparatus 5, a cleaning blade 7, and a charge eliminating lamp 8, in the periphery of the photoreceptor 2.

The charging roll 3 rotates in accordance with the rotation of the photoreceptor 2. A power supply 10 supplies current or voltage generated by superimposing AC on DC to uniformly charge an outer surface of such rotating photoreceptor 2 to a given polarity and potential. In accordance with this exemplary embodiment, the photoreceptor 2 is negatively charged.

Subsequently, laser beam of a modulated image is output from the ROS 4 and irradiated (in the form of scanning exposure) onto the outer surface to be charged of such rotating photoreceptor 2. The potential of an exposed portion is attenuated and an electrostatic latent image is formed.

When the latent image comes to a position for development that faces the development apparatus 5 in accordance with the rotation of the photoreceptor 2, negatively charged toner is supplied from the development apparatus 5 and a toner image is created by the reversal development.

In the downstream of the development apparatus 5, when viewed from a rotational direction of the photoreceptor 2, a conductive transfer roll 6 is arranged in press contact with the photoreceptor 2, and a nip portion of the photoreceptor 2 and the transfer roll 6 form a transfer portion.

When the toner image created on the surface of the photoreceptor 2 reaches the afore-mentioned transfer portion in accordance with the rotation of the photoreceptor 2, a sheet of paper is supplied to the transfer position at a synchronized timing. Simultaneously, a given voltage is applied to the transfer roll 6 and the toner image is transferred to the sheet from the surface of the photoreceptor 2.

The sheet of paper on which the toner image is transferred at the transfer position is fed to a fixing apparatus 9 to fix the toner image on the surface of the paper, and is then output from the image forming apparatus.

Meanwhile, the residual toner on the surface of the photoreceptor 2 after transfer is brushed off by the cleaning blade 7. The surface of the photoreceptor 2 is cleaned for the next image forming process. The electrostatic latent image is deleted by the charge eliminating lamp 8.

In accordance with this exemplary embodiment, there are also provided the power supply 10, a charge detecting portion 11, and a controller 12. The power supply 10 supplies a voltage generated by superimposing AC voltage on DC voltage to the charging roll 3. The charge detecting portion 11 detects a charge amount charged on the photoreceptor 2. The controller 12 controls the voltage supplied from the power supply 10 according to the charge amount detected by the charge detecting portion 11.

Figure 2:
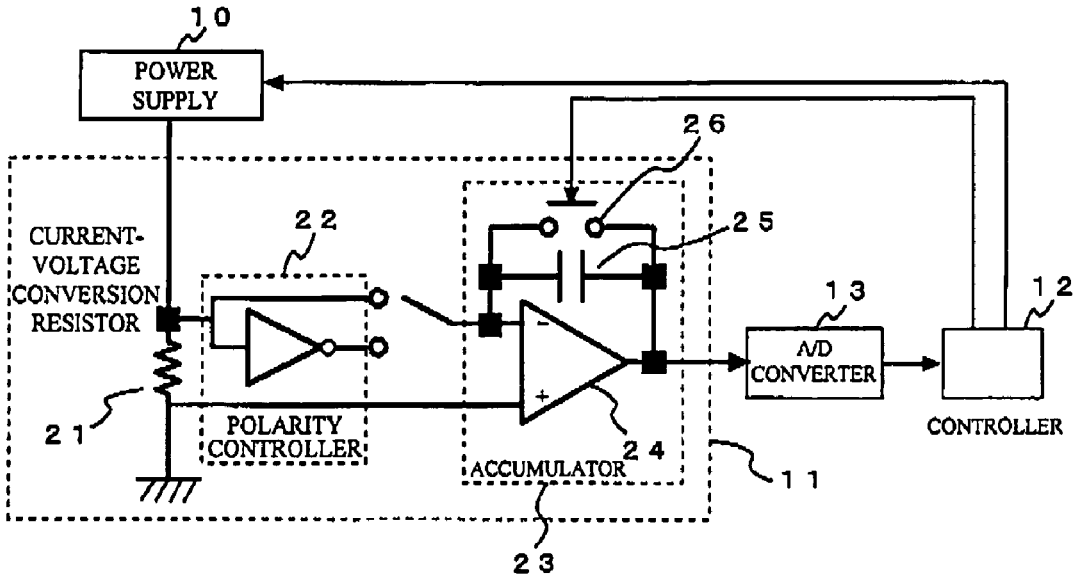
FIG. 2 shows a configuration of a charge detecting portion.

FIG. 2 shows a configuration of the charge detecting portion 11. The charge detecting portion 11 includes a current-voltage conversion resistor 21, a polarity controller 22, and an accumulator 23. The polarity controller 22 changes the polarity of the voltage applied to a calculation circuit in the accumulator 23. The accumulator 23 detects the charge amount charged on the photoreceptor 2. The accumulator 23 includes a calculation amplifier 24, a capacitor 25, and a switch 26, as shown in FIG. 2.

A description will be given of a process for calculating a film thickness d with the charge amount detected by the charge detecting portion 11. The film thickness d is calculated by the following expression.

$d = \epsilon \cdot \text{effective charge length} \cdot \text{photoreceptor diameter} \cdot \pi \cdot V/Q$ (where Q denotes a charge amount, and V denotes an applied voltage)

As seen in the aforementioned expression, terms are constant except Q and V. Accordingly, the film thickness can be detected with higher accuracy than the conventional techniques. Hereinafter, the film thickness of the photoreceptor 2 denotes the thickness of an outermost layer of the photoreceptor 2.

Figure 3:
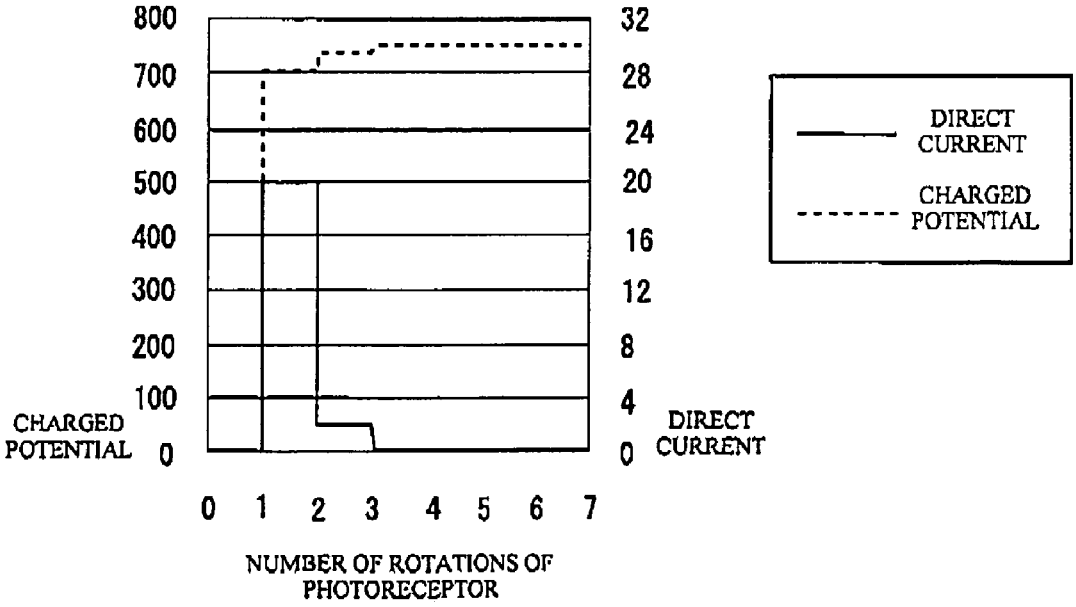
FIG. 3 shows a relationship among number of rotations of a photoreceptor, surface potential of the photoreceptor, and amount of direct current flowing across the photoreceptor.

A description will now be given of a method of detecting the charge on the surface of the receptor with the charge detecting portion 11. FIG. 3 shows the surface potential and direct current when the AC voltage and DC voltage having levels enough to charge the surface are applied. The horizontal axis denotes the number of rotations of the photoreceptor. As the DC voltage, −750 V is applied at the first rotation. The charged potential comes close to −750 V immediately after the DC voltage is applied, yet is unsaturated. Twice or more number of rotations is needed to be saturated (to reach −750 V). The DC current that corresponds to a difference in the charged potential just flows. Therefore, if the film thickness is measured after the first rotation and such applied DC voltage of −750 V results in −700 V on the surface of the photoreceptor, there is a difference of 50 V as a detection error. Also, since the potential after the first rotation varies depending on the film thickness of the photoreceptor, environment, contamination of the charging member, it is impossible to correct with a correction value. In contrast, in accordance with the present invention, the charged potential is detected until the charged potential corresponds to the DC voltage. It is therefore possible to calculate the film thickness accurately without being affected by the above-described error.

A description will now be given of how to deal with the leakage current. The current flowing across the receptor drum 2 is as small as several tens μA. Therefore, the influence of the leakage current has to be considered. As a matter of fact, there is the leakage current of approximately 1 μA, causing an error of approximately 10 percent in the detection. In the conventional techniques, the influence of the leakage current is ignored. The leakage current includes a current-related leakage that does not depend on the voltage value and a resistance-related leakage that varies depending on the voltage value.

Figure 4:
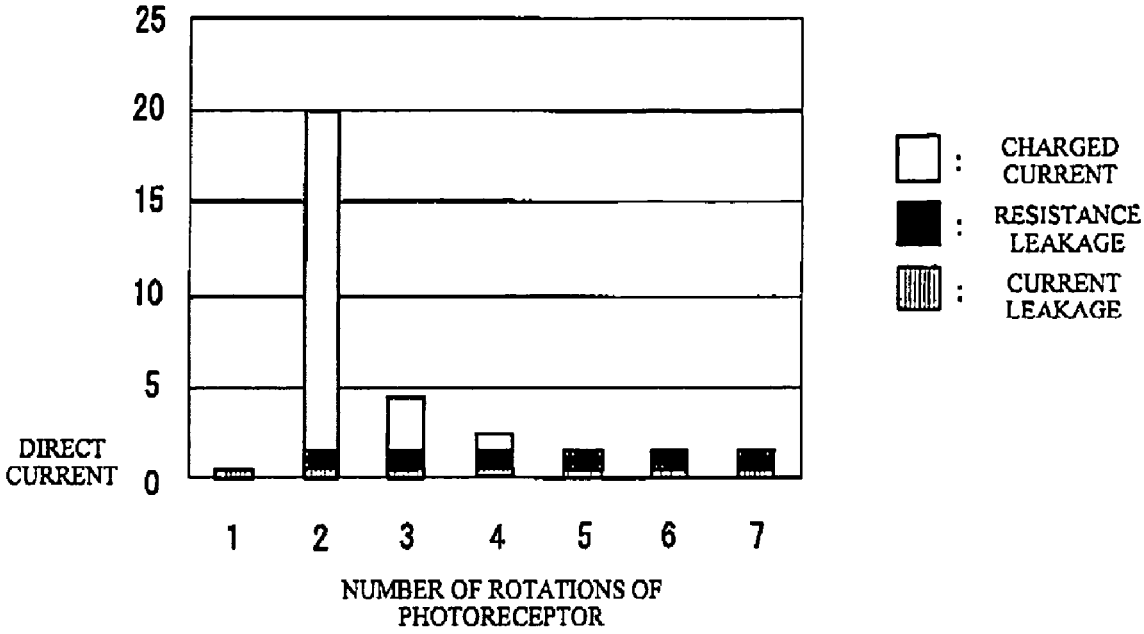
FIG. 4 shows a relationship between the number of rotations of the photoreceptor and the direct current.

FIG. 4 shows the DC current in each number of rotations of the photoreceptor drum 2. A signal is applied at the rotation timing of a rotation number 2 of the photoreceptor 2. The current-related leakage flows at a rotation number 1 of the photoreceptor 2. At the rotation number 2, included are the current-related leakage, the resistance-related leakage that flows across the resistance component, and the charging current that contributes to charging. At rotation numbers 5 through 7, the potential is saturated and the charging current flows no more, but only the leakage current flows.

It is therefore possible to obtain only the charging current by deducting an accumulated value of the current at rotation numbers 5 through 7 from an accumulated value of the current at rotation numbers 2 through 4. To deduct the accumulated value is carried out by selectively changing the connection of the polarity controller 22. The deduction is realized by reversing the polarity of the signal on the polarity controller 22 at the rotation numbers 5 through 7, while the current is being accumulated at the rotation numbers 2 through 7.

In accordance with this exemplary embodiment, the film thickness is detected by the charge in the charging process of applying the DC voltage. However, it is possible to detect the film thickness in a discharging process in the charged state. It is also possible to partially discharge the photoreceptor drum 2 in an exposure process and subsequently charge the photoreceptor drum 2 to detect the charge amount and detect the film thickness partially. In the same manner as described, it is possible to detect the film thickness by partially discharging.

[Second Embodiment]

Figure 5:
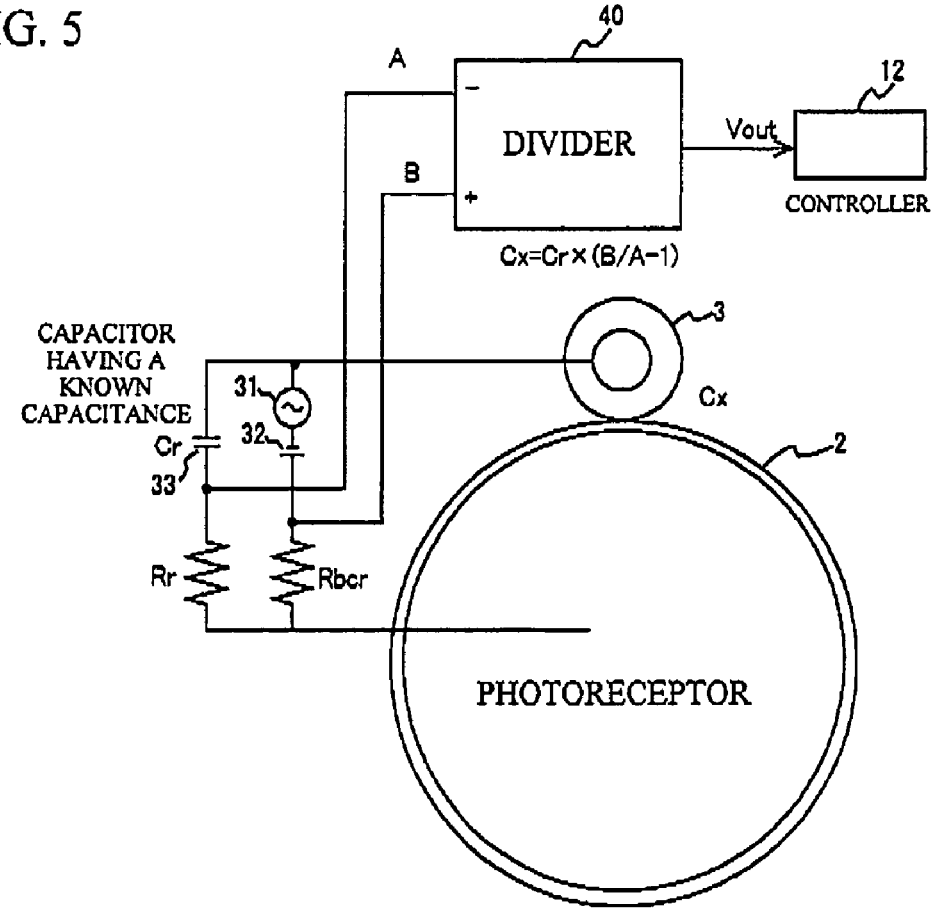
FIG. 5 is a view showing a configuration of the image forming apparatus in accordance with a second exemplary embodiment of the present invention.

A second exemplary embodiment of the present invention will be described. Referring now to FIG. 5, power supplies (an AC power supply 31 and a DC power supply 32) are provided for the charging roll 3, and are connected in parallel with a capacitor 33 having a known capacitance. With the ratio of current flowing across the capacitor 33 having a known capacitance to current flowing across the charging roll 3, the capacitance between the charging roll 3 and the photoreceptor drum 2 is obtained. More specifically, a divider 40 shown in FIG. 5 calculates the ratio of current flowing across the capacitor 33 having a known capacitance to current flowing across the charging roll 3, and multiplies the capacitance of the capacitor 33.

In the afore-described calculation, the capacitance is not influenced by AC frequency applied to the charging roll 3 or an output impedance of the AC power supply. Even if the waveform is not a sine wave or the waveform is rectangular, triangular, or distorted due to a clamped voltage at a given voltage or higher, the similar waveform will also be applied to the capacitor 33 having a known capacitance and will not deteriorate the measurement accuracy. If the dielectric constant of the photoconductive layer varies depending on the environment as described in Document 3, it is possible to manufacture the dielectric layer of the capacitor 33 and the photoreceptor drum 2 with a same material to cancel the influence.

The capacitance observed between the charging roll 3 and the photoreceptor drum 2 is determined by a contact area of the nip portion. The contact area of the nip portion is different according to the photoreceptor. So, even if the capacitance is measured, such measured capacitance cannot be converted into the film thickness.

Figure 6:
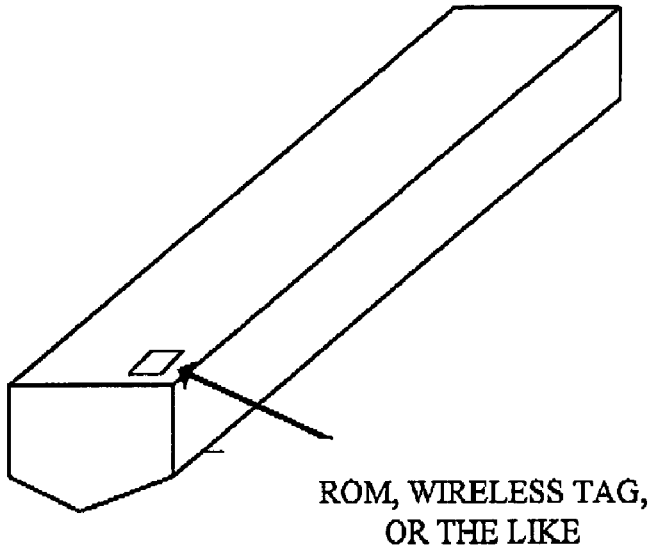
FIG. 6 shows a configuration of a photoreceptor unit.

The photoreceptor drum 2 and the charging roll 3 are integrally provided as consumables. Accordingly, the nip portion functions constantly until the operating life ends. Referring now to FIG. 6, values of an initial capacitance×film thickness of the photoreceptor=dielectric constant of the photoreceptor×area of the nip portion are stored in a photoreceptor unit in which the photoreceptor drum 2 and the charging roll 3 are integrally formed. If the film thickness of the photoreceptor has to be known, the thickness is obtainable by dividing such stored value by the capacitance. It is therefore possible to obtain an absolute film thickness by calculation after the capacitance is detected, since the photoreceptor unit stores the ratio of the film thickness to the capacitance before abrasion.

The area of the contact portion, namely, the nip portion changes in accordance with the rotation due to decentering of the photoreceptor drum 2 and the charging roll 3, and an accurate film thickness is not obtainable with the capacitance value at the time of detection.

Figure 7:
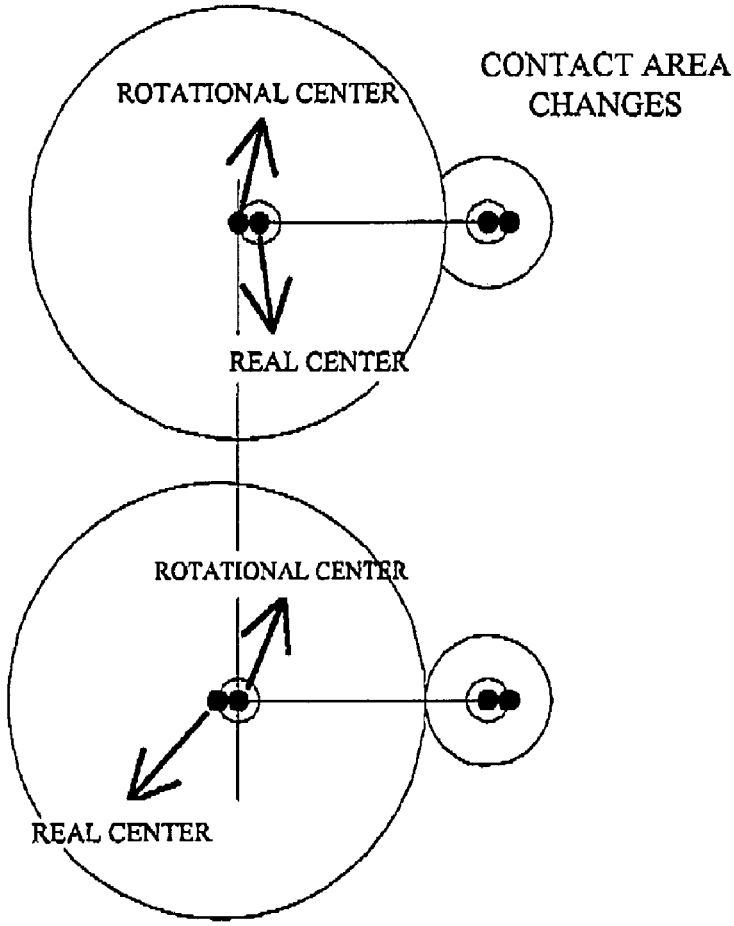
FIG. 7 shows decentering of the photoreceptor and a charging roller.
Figure 8:
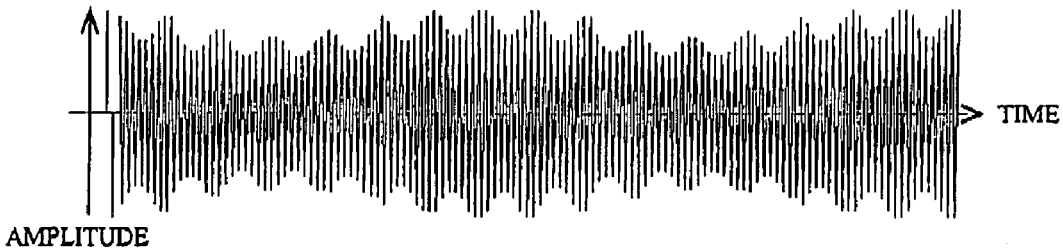
FIG. 8 shows how a distance between the photoreceptor drum and the charging roller is changed by decentering.

Referring now to FIG. 7, the photoreceptor drum 2 and the charging roll 3 decenter. $\omega 1$ and $\omega 2$ denote angular velocities of the charging roll 3 and the photoreceptor drum 2, respectively. A distance between the center of the charging roll 3 and the surface of the photoreceptor 2 or the distance between the center of the charging roll 3 and the center of the photoreceptor drum 2 is obtainable by the expression below, with the use of the addition value and subtraction value of $\omega 1$ and $\omega 2$. FIG. 8 shows how the distance between the photoreceptor drum 2 and the charging roll 3 is changed by decentering. As shown in FIG. 8, the waveform has the shape where AC modulation is carried out by two frequencies.

$$\mathrm{Cos}\ \omega 1t+\cos\ \omega 2t=2\ \mathrm{Cos}\ ((\omega 1t+\omega 2t)/2)\times \mathrm{Cos}\ ((\omega 1-\omega 2)$$

This exhibits that the current applied from the charging roll 3 and flowing across the photoreceptor 2 has only to be averaged over the period equal to or greater than the difference between $\omega 1$ and $\omega 2$ in order to suppress the measurement error of the film thickness due to the change in distance. Practically, it is possible to measure the film thickness with less error by passing through a lowpass filter with cutoff frequency fc higher than a period thereof, or by integrating with the period.

Figure 9:
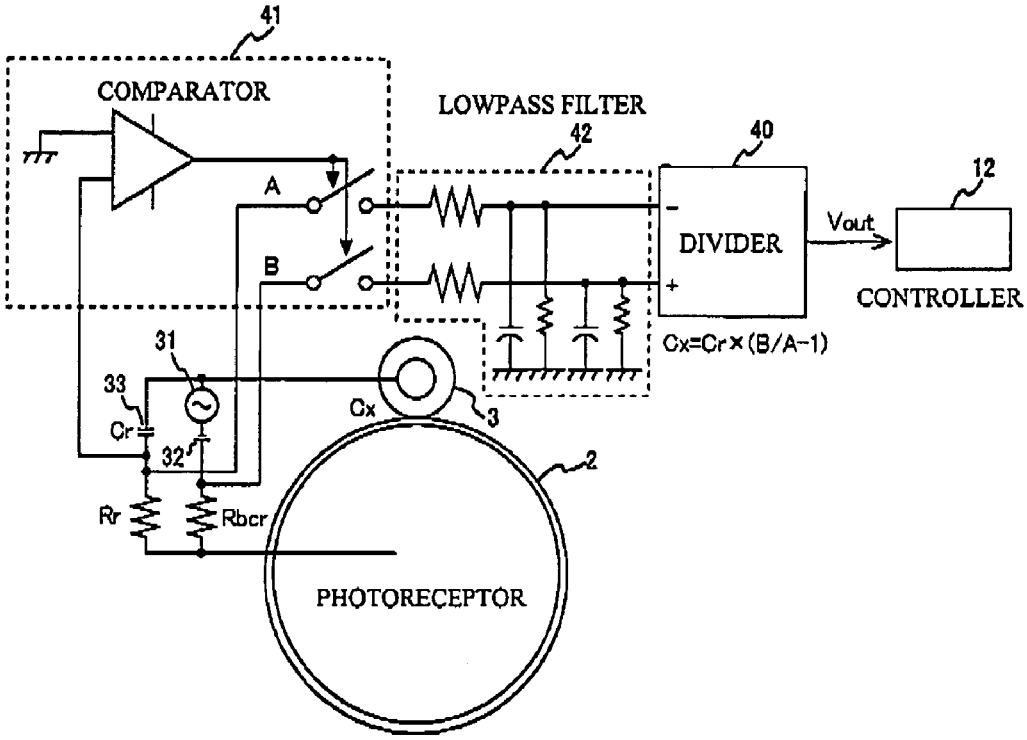
FIG. 9 through FIG. 11 show configurations of a rectifier circuit and a lowpass filter.
Figure 10:
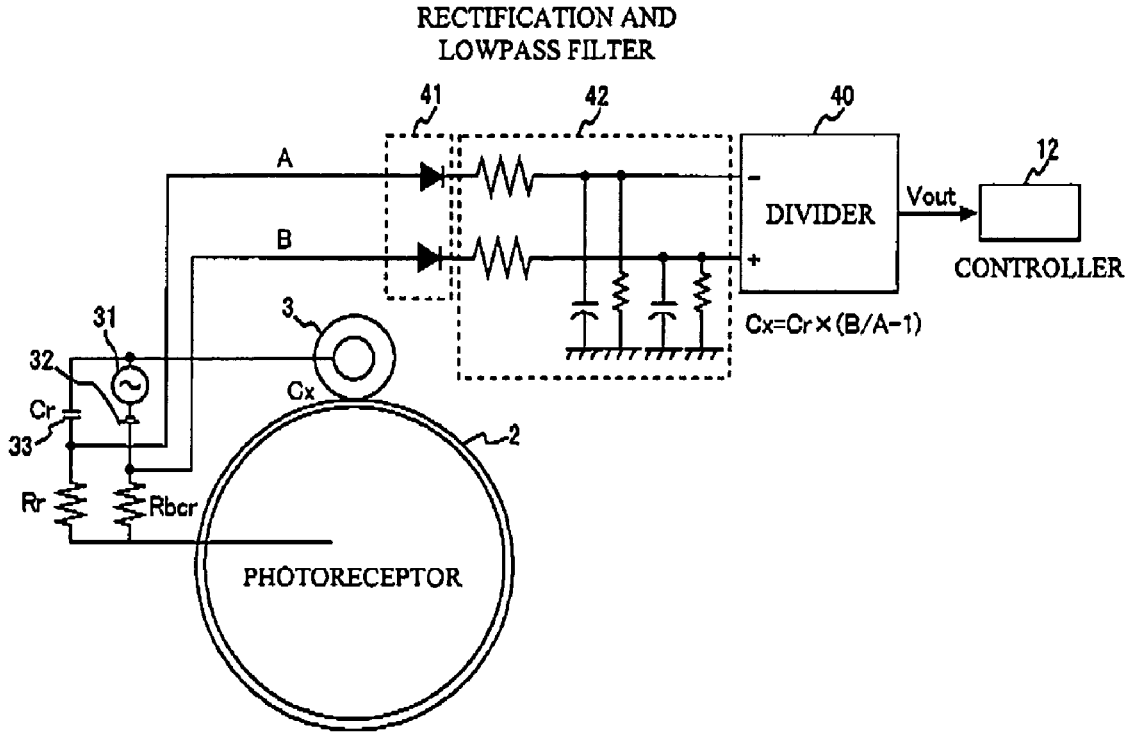
Figure 11:
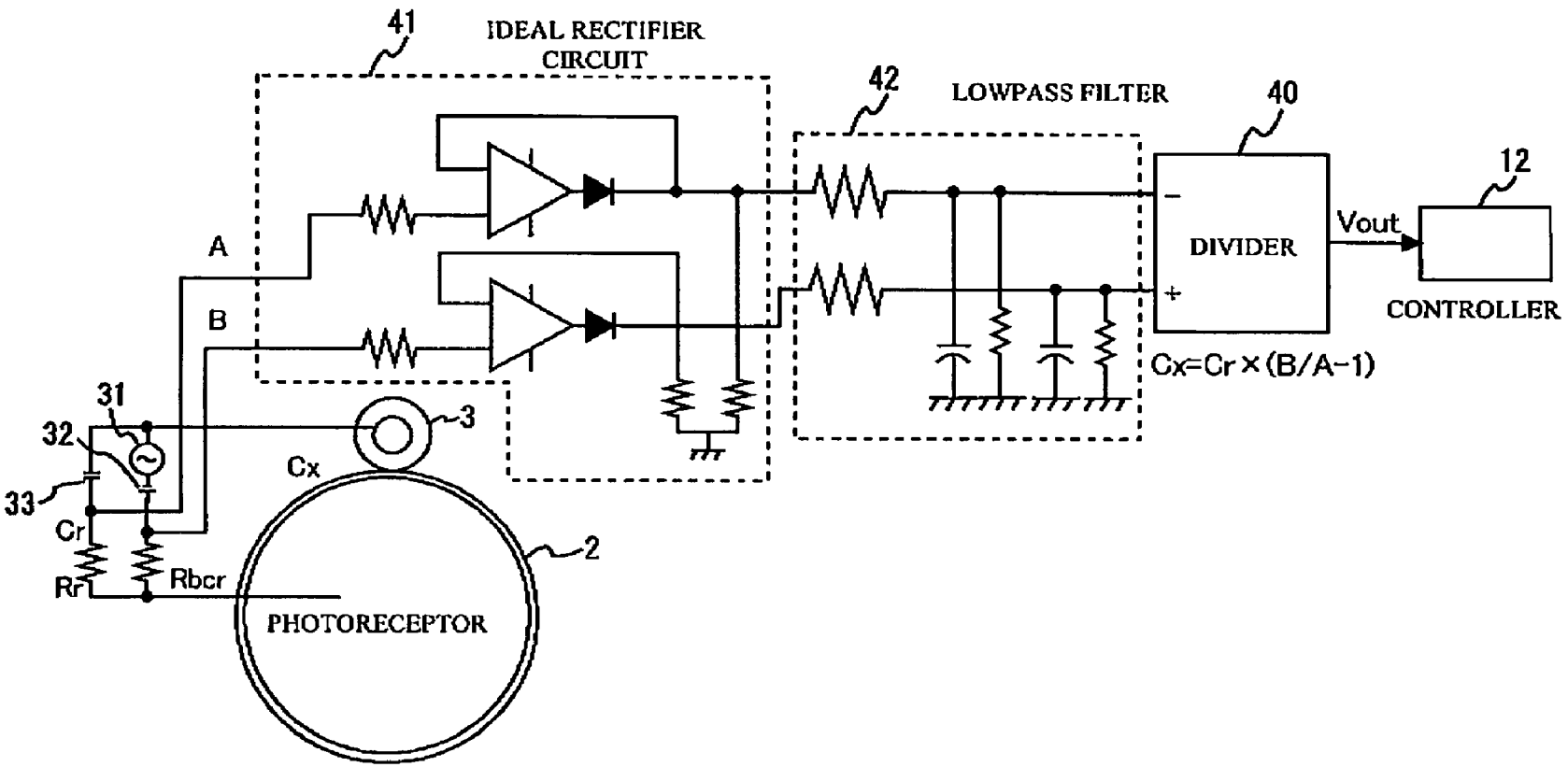

FIG. 9 through FIG. 11 show configurations of a rectifier circuit 41 and a lowpass filter 42. A circuit shown in FIG. 9 includes a comparator that serves as the rectifier circuit 41 to make the comparator turn on and off switches A and B for rectification. The lowpass filter 42 is a generally used filter that includes resistors and capacitors.

The rectifier circuit 41 rectifies with the use of diodes. Referring now to FIG. 11, operational amplifiers are provided in former stages of the diodes to compensate for the operations of the diodes. In this manner, it is possible to reduce the error by processing the signal that has passed through the lowpass filter and to obtain the film thickness of the photoconductor with accuracy.

[Third Embodiment]

A description will now be given of a third exemplary embodiment of the present invention. In the third exemplary embodiment, before the charge amount is detected, the potential of the photoreceptor is controlled to have an initial voltage V1. Then, the voltage is applied to the photoreceptor 2 to set the potential of the photoreceptor 2 to a given voltage V2. At this time, current flowing through the photoreceptor 2 is accumulated for calculating the charge amount, and then the thickness is calculated with the charge amount. In accordance with this exemplary embodiment, the surface potential V1 before the charge amount is detected and the surface potential V2 after the charge amount is detected are necessary. Therefore, the surface potentials V1 and V2 have to be controlled with accuracy. Before the charge amount is detected, the potential of the photoreceptor is set at a given potential for an ideal integration. This enables to calculate the charge amount with accuracy and measure the thickness with accuracy.

In accordance with this exemplary embodiment, the photoreceptor 2 is an aluminum drum having a diameter of 30 mm, and has an outer surface coated with an OPC photoconductive layer. The photoreceptor also includes a carrier transfer layer having the film thickness d of 29 μm provided on a charge generating layer. There are some cases where the voltage remains on the photoreceptor 2 according to use conditions. Even if the DC voltage of 0 V is applied to the photoreceptor 2 having such residual voltage thereon, the potential of the photoreceptor 2 is not 0 V. There will be an error, if the applied voltage is not equal to the potential of the photoreceptor in the calculation of the film thickness. For this reason, a given voltage of equal to or less than minus tens of DC voltage, instead of 0 V, is applied so that the surface potential of the photoreceptor can have a given state. This eliminates the influence of the residual voltage. Subsequently, the process of detecting the charge amount is implemented.

The surface potential V1 is controlled to the surface potential V2 on the photoreceptor 2, by applying the voltage generated by superimposing AC voltage on DC voltage to the charging roll 3. At this time, when the surface potential V2, which is different from the surface voltage V1, is applied as the DC voltage, the surface potential V2 is obtainable at the time of saturation on the surface potential of the photoreceptor 2. Whether the surface potential of the photoreceptor 2 is saturated enough to have the surface potential V2 is determined by whether a predetermined period for saturation, which has been obtained already in the experiment, has passed. The afore-mentioned period may be replaced by the number of rotations of the photoreceptor 2. Also, the DC current flowing across the photoreceptor 2 is monitored, and it is possible to determine the saturation when there is no change in the DC current. Alternatively, an inexpensive relative surface potential electrometer may be used for detecting and determining the saturation of the surface potential.

While the charge amount is being measured by applying the voltage generated by superimposing AC voltage on DC voltage to the charging roll 3, a development roll of the development apparatus 5 and the transfer roll 6 are set to have an electrically high resistance. In addition, the ROS 4 and the charge eliminating lamp 8 are set to off. In order to set such an electrically high resistance, the development roll and the transfer roll 6 are mechanically separated from the photoreceptor 2. Alternatively, the development roll and the transfer roll 6 are configured to have the same potential as the photoreceptor 2 in an electrically floating state. Alternatively, the power supply 10 is controlled so that current may not flow into the photoreceptor 2 from the development roll or the transfer roll 6. The controller 12 controls the afore-described operations. However, in a case where the current flowing into the photoreceptor 2 from the development roll or the transfer roll 6 is known, the current can be corrected later.

Figure 12:
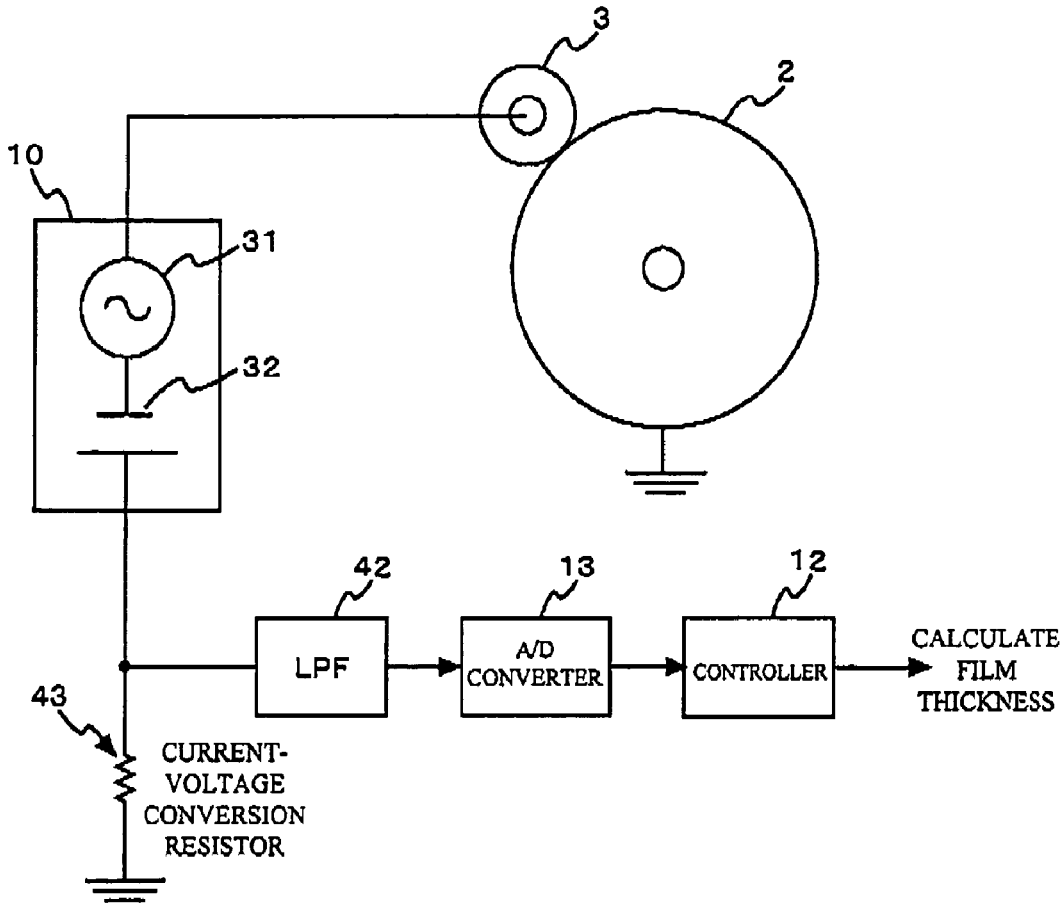
FIG. 12 shows a configuration of a functional portion that detects the charge amount in the image forming apparatus in accordance with a third exemplary embodiment of the present invention.

FIG. 12 shows a configuration of a functional portion where the charge amount is calculated by integrating the DC current flowing across the photoreceptor 2 and the film thickness is calculated by such calculated charge amount. The functional portion shown in FIG. 12 includes a current-voltage conversion resistor 43, the lowpass filter 42, an A/D converter 13, and the controller 12. The current-voltage conversion resistor 43 converts current flowing across the photoreceptor 2 into the voltage. Hereinafter, the lowpass filter 42 is simply referred to as LPF 42.

The voltage detected by the current-voltage conversion resistor 43 includes AC component superimposed on DC component of the power supply 10. Therefore, the AC frequency is attenuated in the LPF 42. Also, the LPF 42 is capable of removing the AC component and lowering the sampling frequency. According to sampling theorem, the frequency is configured to have equal to or more than twice as long as the AC period of the power supply as a sampling period. In this case, it can be considered that the load for digital processing is increased with the increased data amount to be sampled. For this reason, the LPF 42 is provided for eliminating the AC component to lower the sampling frequency. This makes it possible to reduce the load for the digital processing without deteriorating the detection accuracy.

The upper limit of the sampling period is configured so that the accuracy may not degrade within the control period for changing the DC voltage. If the DC voltage changes in 50ms, the sampling period has to be set within 50 ms. The sampling period may be identical in all periods during the thickness detection. Alternatively, the period may be shortened only while there is a change.

The controller 12 accumulates digital voltage values converted by the A/D converter 13 to obtain the charge amount. In addition, the accumulation period may be determined by the number of rotations of the photoreceptor 2 as described above, or may be determined at the time when there is no change in the DC current while the DC current flowing across the photoreceptor 2 is being monitored. Furthermore, an inexpensive relative surface potential electrometer may be utilized for detecting and determining the saturation of the surface potential.

The film thickness of the photoreceptor is calculated in the following expression with the use of the charge amount obtained by accumulating the voltages.

The film thickness d of the photoconductive layer=$\epsilon$·effective charge length·photoreceptor diameter·$\pi$·|V2−V1|/Q Q denotes the charge amount, V1 denotes the DC voltage applied to the photoreceptor 2 before detection, and V2 denotes the DC voltage applied to the photoreceptor 2 at the time of detection.

In a case where the initial film thickness is known before the photoreceptor 2 is worn out, the charge amount is measured before the photoreceptor 2 is worn out to be set as an initial charge amount. The film thickness d is obtainable with the ratio of the initial charge amount to the charge amount measured after the photoreceptor 2 is worn out.

The film thickness d of the photoreceptor=initial thickness×initial charge amount/currently detected charge amount No parameter items are needed in the afore-described calculation method, thereby eliminating the individual difference of the photoreceptor 2 or the charging roll 3 and enabling the film thickness to be calculated with high accuracy.

Figure 13:
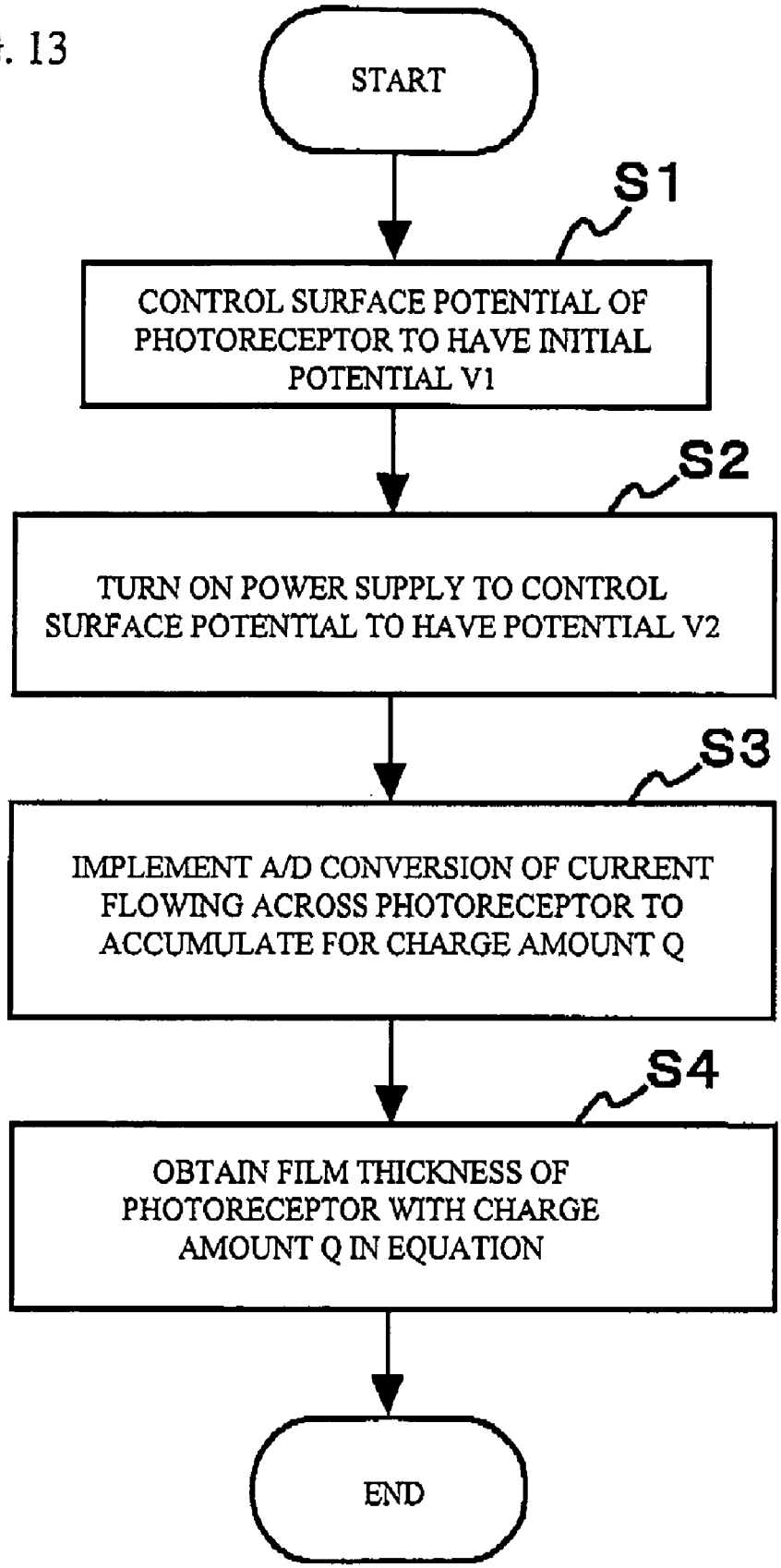
FIG. 13 is a flowchart showing an operation procedure in accordance with the third exemplary embodiment of the present invention.

Referring now to FIG. 13, an operation procedure in accordance with the present invention will be described. The surface potential is first controlled to have the initial potential V1 (at step S1). Here, the voltage generated by superimposing AC voltage on DC voltage is applied to the charging roll 3, and the potential of the photoreceptor 2 is set to V1.

Next, the voltage generated by superimposing AC voltage on DC voltage is applied to the charging roll 3 and the surface potential of the photoreceptor 2 is controlled to have the potential V2 (at step S2). At this time, the potential V2, which is different from V1, is applied as the DC voltage. When the surface potential of the photoreceptor 2 is saturated, the surface potential is changed to V2. At this time, current flowing across the photoreceptor 2 is converted into the voltage by the current-voltage conversion resistor 43. Then, the voltage is converted by the A/D converter 13 to obtain the charge amount Q (at step S3). Such obtained charge amount Q, the effective charge length, the photoreceptor diameter, and the surface potentials V1 and V2 of the photoreceptor 2 are assigned to the above-described expression to obtain the film thickness d of the photoreceptor 2.

Figure 14:
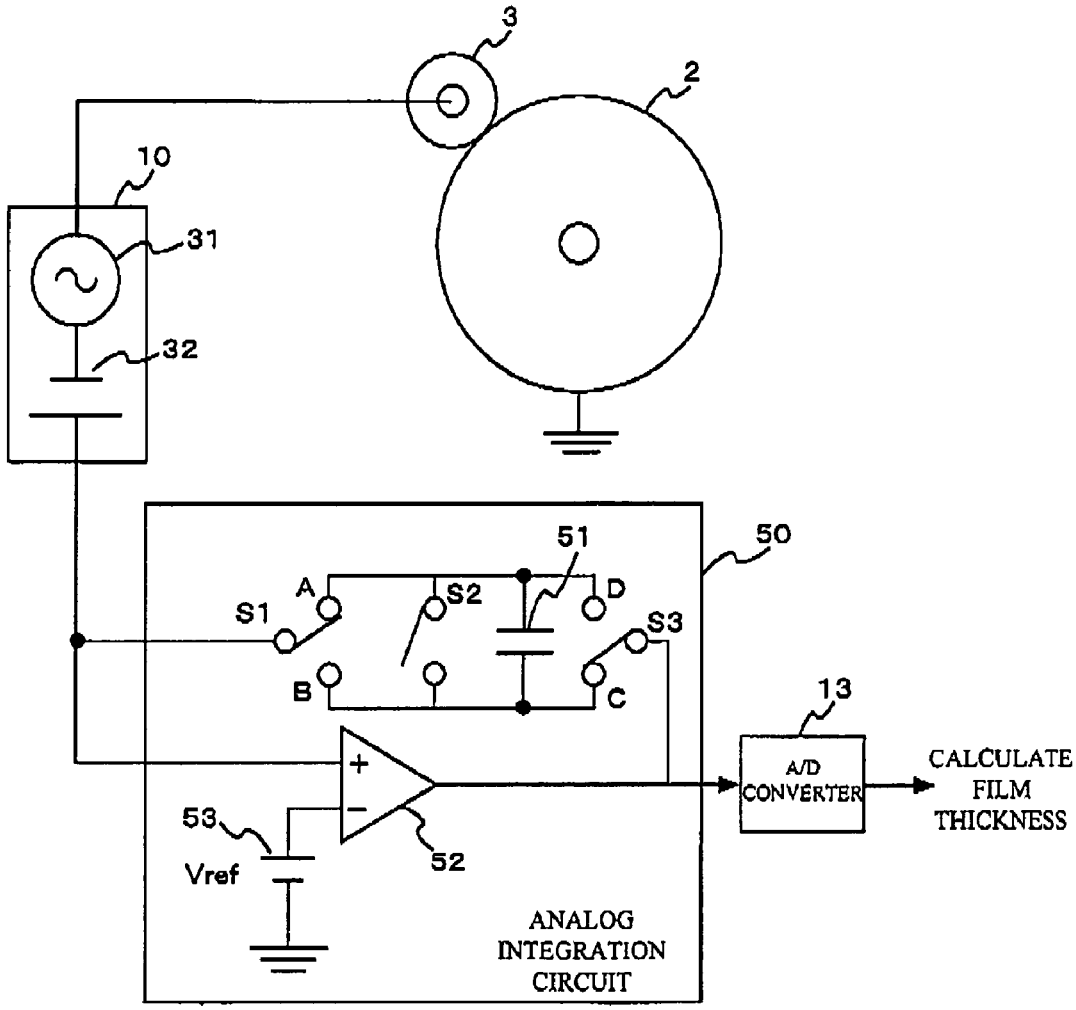
FIG. 14 is a view showing a configuration of an analog integration circuit.

Referring now to FIG. 14, an analog integration circuit 50 may be used for calculating the charge amount. The analog integration circuit 50 is an ideal method that does not generate an integration error, although the sampling period integrated by a digital integration method leads to an integration error. Current flowing across the photoreceptor 2 is stored in a capacitor C51 as the charge, and the amount of the charge is converted into voltage and is then output. The A/D converter 13 implements AD conversion of the voltage. Switches S1 and S3 are provided for selectively changing the direction of current flowing through the capacitor C51. Current flowing across the photoreceptor 2 is stored in the capacitor C51 by changing the switch S1 to be connected to a terminal A in FIG. 14 and changing the switch S3 to be connected to a terminal C in FIG. 14. In contrast, current flowing across the photoreceptor 2 can be reduced in the capacitor C51 by changing the switch S1 to be connected to a terminal B in FIG. 14 and changing the switch S3 to be connected to a terminal D in FIG. 14. A switch S2 discharges the capacitor C51, and resets such stored charge to zero.

An operation of the analog integration circuit 50 shown in FIG. 14 is described. The switch S2 is first short-circuited to discharge the capacitor C51 to set the charge amount to zero. The switch S2 is then opened, and a voltage for charging is applied to the photoreceptor 2 having a given potential V1 to control the surface potential to V2. At this time, the capacitor C51 stores the charge of current flowing across the photoreceptor 2 and the leakage current. Then, the switches S1 and S3 are changed when the surface potential of the photoreceptor 2 is saturated. The switch S1 is changed to be connected to the terminal B from the terminal A, and the switch S3 is changed to the terminal D from the terminal C. At this time, the potential is saturated and there is no current flowing across the photoreceptor 2. Accordingly, only the leakage current flows. Also, the polarity of the current is changed and the charge is reduced by the amount of the leakage current. After the connections of the switches S1 and S3 are changed, and a period while the surface potential of the photoreceptor 2 is saturated has passed since a voltage is applied to the photoreceptor 2, the output value is obtainable by the current flowing across the photoreceptor 2. Such output value is used for calculating the film thickness as the detected charge amount.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An image forming apparatus comprising:

a photoreceptor that rotates;

a charging member provided in contact with or in close proximity of the photoreceptor to charge the photoreceptor;

a charge amount detecting portion that accumulates current flowing across the photoreceptor to obtain a charge amount of the photoreceptor, while the current is being applied from the charging member until a voltage on a surface of the photoreceptor substantially corresponds to the voltage applied by the charging member; and a controller that calculates a film thickness of the photoreceptor based on the charge amount.

2. The image forming apparatus according to claim 1, wherein the charge amount detecting portion accumulates the current flowing across the photoreceptor from the charging member, when a surface potential is charged to a given potential after the surface potential of the photoreceptor is set to an initial potential.

3. The image forming apparatus according to claim 1, wherein:

the charge amount detecting portion accumulates the current when the photoreceptor is saturated, and detects an error amount in the charge amount caused by a leakage current; and the charge amount detecting portion deducts the error amount from the charge amount.

4. The image forming apparatus according to claim 1, further comprising an exposure portion that exposes the surface of the photoreceptor, wherein the charge amount detecting portion accumulates the current flowing across the photoreceptor to obtain the charge amount of the photoreceptor, while the current is being applied from the charging member again after the photoreceptor is exposed by the exposure portion, until the voltage on the surface of the photoreceptor substantially corresponds to the voltage applied by the charging member.

5. The image forming apparatus according to claim 1, wherein the controller controls a development portion and a transfer portion to have an electrically high resistance, when the charge amount is detected.

6. The image forming apparatus according to claim 1, wherein the controller turns off a charge eliminating lamp and an exposure portion, when the charge amount is obtained.

7. The image forming apparatus according to claim 1, wherein the charge amount detecting portion is an analog integration circuit.

8. The image forming apparatus according to claim 1, wherein the controller multiplies a ratio of a first charge amount to a second charge amount by a first film thickness of the photoreceptor to calculate a second film thickness of the photoreceptor, the first charge amount being measured by the charge amount detecting portion before the photoreceptor is worn out, the second charge amount being detected by the charge amount detecting portion after the photoreceptor is worn out, the first film thickness being measured by the charge amount detecting portion before the photoreceptor is worn out, the second film thickness being a current film thickness after the photoreceptor is worn out.

9. An image forming apparatus comprising:

a photoreceptor that rotates;

a charging member provided in contact with or in close proximity of the photoreceptor to charge the photoreceptor;

a charge amount detecting portion accumulates current flowing across the photoreceptor to obtain a charge amount of the photoreceptor, while the photoreceptor that has been charged is being discharged until a voltage on a surface of the photoreceptor substantially corresponds to a ground level,; and a controller that calculates a film thickness of a photoreceptor with the charge amount.

10. An image forming apparatus comprising:

a photoreceptor that rotates;

a charging member provided in contact with or in close proximity of the photoreceptor to charge the photoreceptor;

a capacitor having a known capacitance that is connected in parallel with the charging member;

a current detecting member that detects a first current amount and a second current amount, the first current amount flowing into the capacitor, the second current amount flowing across the photoreceptor from the charging member; and a controller that detects a capacitance between the charging member and the photoreceptor with a ratio of the first current amount to the second current amount.

11. The image forming apparatus according to claim 10, further comprising a memory portion that stores a first film thickness of the photoreceptor and a first capacitance between the photoreceptor and the charging member, the first film thickness being obtained before the photoreceptor is used, the first capacitance being detected by the controller before the photoreceptor is used, wherein the controller calculates a second film thickness of the photoreceptor with the ratio of the first film thickness multiplied by the first capacitance to a second capacitance between the photoreceptor and the charging member, the second film thickness being a current film thickness after the photoreceptor is used, the second capacitance being detected by the controller after the photoreceptor is used.

12. The image forming apparatus according to claim 10, further comprising:

a rectifier that detects and rectifies the second current amount; and a lowpass filter that cuts off frequencies that corresponds to a frequency equal to or greater than a difference in rotation between the photoreceptor and the charging member.

* * * * *